United States Patent [19]

Sanko

[11] 4,173,300

[45] Nov. 6, 1979

[54] HEAT CONDITIONING APPARATUS FOR SHIRT OR BLOUSE-LIKE GARMENT

[75] Inventor: John R. Sanko, Altoona, Pa.

[73] Assignee: Paris Manufacturing Company, Inc., Brockway, Pa.

[21] Appl. No.: 877,947

[22] Filed: Feb. 15, 1978

[51] Int. Cl.[2] ..... D06F 73/00

[52] U.S. Cl. ..... 223/70; 34/103

[58] Field of Search ..... 223/67, 69, 70, 73, 223/76, 51; 34/103, 239

[56] References Cited

U.S. PATENT DOCUMENTS

| | | | |
|---|---|---|---|
| 2,338,776 | 1/1944 | Miller | 223/70 X |
| 3,568,900 | 3/1971 | Paris | 223/70 |
| 3,866,808 | 2/1975 | Bailey | 223/73 |
| 3,883,051 | 5/1975 | Bailey | 223/70 X |
| 3,934,766 | 1/1976 | Bailey | 223/73 |

*Primary Examiner*—Louis Rimrodt

*Attorney, Agent, or Firm*—Parmelee, Miller, Welsh & Kratz

[57] ABSTRACT

An upright apparatus for heating and conditioning shirts, blouses, jackets and leisure top clothing or garments has a hot-air-supplying, supporting and positioning base part on which an upright, tubular steamer assembly having inner and outer tube element pairs is operatively positioned. A steam supply and recycling system is connected to inner tubes of the pairs in such a manner to continuously indirectly apply heat along outer tubes of the pairs within a garment conditioning chamber defined by an upwardly extending, garment-supporting, permeable bag; dry, high pressure steam is supplied to the outer tubes to periodically directly apply bursts of hot steam within the chamber. To enable a maximum utilization of the heated steam as supplied from a source, such as a boiler, the output from the tube assembly is passed through an air heating heat exchanger positioned in the base part before it is returned to the boiler.

6 Claims, 10 Drawing Figures

HEAT CONDITIONING APPARATUS FOR SHIRT OR BLOUSE-LIKE GARMENT

BACKGROUND OF THE INVENTION

1. Field of the Invention

This invention pertains to improved apparatus or equipment for garment finishing or conditioning operations which involves the use of a permeable fabric bag on which a garment to be conditioned is positioned and through which hot air and dry steam are to be applied to the garment. An important phase of the invention deals with the provision and employment of a tubular assembly or unit for utilizing a continuous flow of steam to provide a constant heat within the permeable bag, and for directly applying steam bursts within the bag during a garment finishing or conditioning operation.

2. Description of the Prior Art

Garments in the nature of shirts, blouses, etc., initially after manufacture, and later in a used condition, after laundering or dry cleaning, require finishing or conditioning and, in this connection, an expansible permeable bag-like fabric form, such as of nylon, has been employed to carry the garment while it is being subjected internally to heated air and substantially directly to hot, high pressure applied steam. This practice has required the use of relatively so-called dry steam to avoid excessive moisture as applied to the garment. Also, it has been customary, for example, as illustrated in Paris U.S. Pat. No. 3,568,900, to effect the application of steam from a relatively remote location, namely, from a steamer located at the juncture of a lower support base part and the upper bag form carrying part. At the same time, hot air supplied by the base part is moved upwardly into the bag along with the steam. Paris U.S. Pat. Nos. 2,417,838 and 2,915,229 are also representative of such a type of operation.

Although the above-mentioned practice makes use of a somewhat remote, direct introduction of steam within the chamber of the permeable bag and thus, to the garment positioned thereon, it has been determined that it is necessary to use a relatively dry, high pressure steam to avoid excessive moisture as applied to the garment. Considerable moisture collects within the base part that has to be removed. Also, such moisture is subject to pick-up from the hot air that is issuing upwardly from the base part. It is important to avoid spotting of the garment, such as will occur from moisture applied under steam pressure to the garment and thus, it is important to supply the steam with maximum dryness.

There has thus been a need for an apparatus which will, in itself, avoid the need for use of a remote steam introducing unit and which will enable the direct introduction of steam within the permeable bag form with a maximized reduction of moisture or condensate. In this connection, it has been found to be desirable to supply the steam for best efficiency and uniformity of garment conditioning along substantially the full length of the bag on which the garment is positioned.

There has thus been a need for an apparatus for more efficiently introducing steam and heated air and applying them as well as heat of the steam to a garment being conditioned or finished. This should be accomplished in such a manner as to substantially eliminate condensation within the conditioning chamber and importantly, to effectively eliminate steam spotting of the garment being finished.

Summarized briefly, there has been a need for an improvement in the manner of and in the apparatus for supplying heated air, steam heat and steam bursts to the inside of the bag form on which the garment is being finished.

SUMMARY OF THE INVENTION

It has thus been an object of the invention to meet the problem above-outlined and provide a garment finishing apparatus embodying an improved and better controlled useage of steam.

Another object has been to devise an improved garment finishing machine in which the heat and garment-conditioning fluid in the nature of steam and air may be more accurately supplied and controlled to accomplish an improved operation.

Another object has been to meet the heretofore limiting factors involved in the utilization of steam and enable its better and more effective utilization in accomplishing a garment finishing operation.

A further object has been to devise a garment finishing apparatus in which the operation may be expedited and accomplished more efficiently, particularly from the standpoint of utilization of high pressure steam.

A still further object of the invention has been to devise a garment finishing apparatus having a longitudinal, dual-functioning assembly through which heated steam is indirectly supplied during a garment finishing operation and from which high pressure steam is directly supplied only as needed in an accurate and controlled manner by the utilization of steam bursts substantially along the extent of the chamber defined by a permeable bag form.

These and other objects will appear to those skilled in the art from the illustrated embodiment and the claims.

Figures 7, 8, 9:
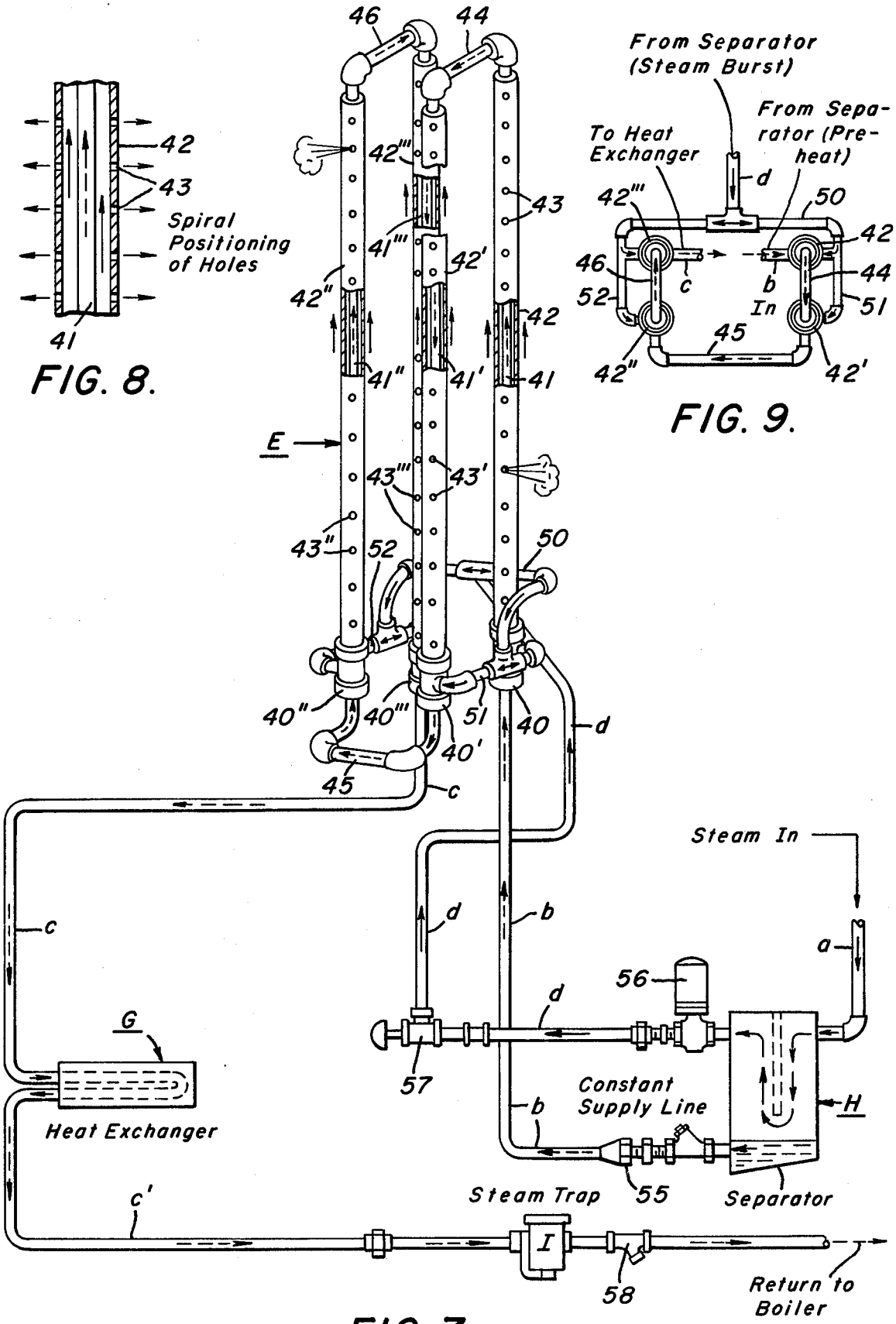
FIG. 7 is a system schematic and tubular assembly perspective view illustrating utilization of hot, high pressure steam in both directly and indirectly applying conditioning fluid within the chamber of an upper garment supporting part of the apparatus.
FIG. 8 is an enlarged vertical fragment taken through a representative dual tubular element pair of the assembly of FIG. 7, particularly showing the staggered orifices or out-flow openings in the wall of an outer tube element for enabling the direct supply of steam in bursts with and along the chamber of a permeable bag.

And, FIG. 9 is a reduced top plan, somewhat schematic view of the tubular assembly shown in FIG. 7, illustrating steam flow connections to inner and outer tube elements of element pairs of such assembly. It will be noted that these two FIGURES show the apparatus turned 180° with respect to FIG. 1.

DESCRIPTION OF THE PREFERRED EMBODIMENT

Figure 1A:
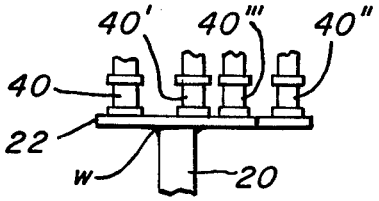
FIG. 1A is a side elevation showing detail of the construction of a support table of FIG. 1 that is mounted to carry a steam utilizing tubular assembly further illustrated in FIGS. 7, 8 and 9.
Figure 1:
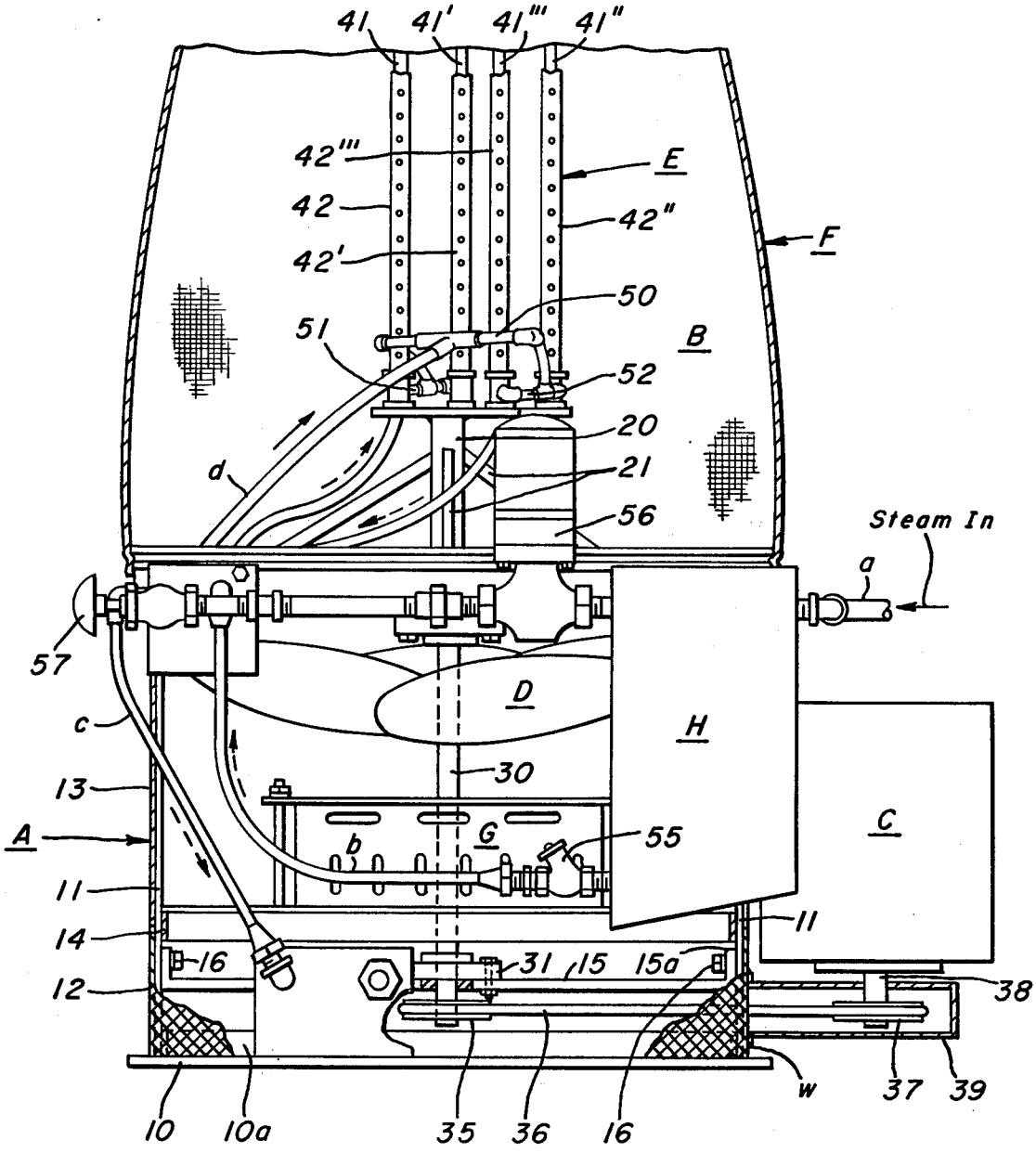
FIG. 1 is a vertical sectional view of apparatus embodying the invention and representatively showing a permeable fabric bag which is supported and used in a conventional manner for receiving a garment to be finished.
Figure 2:
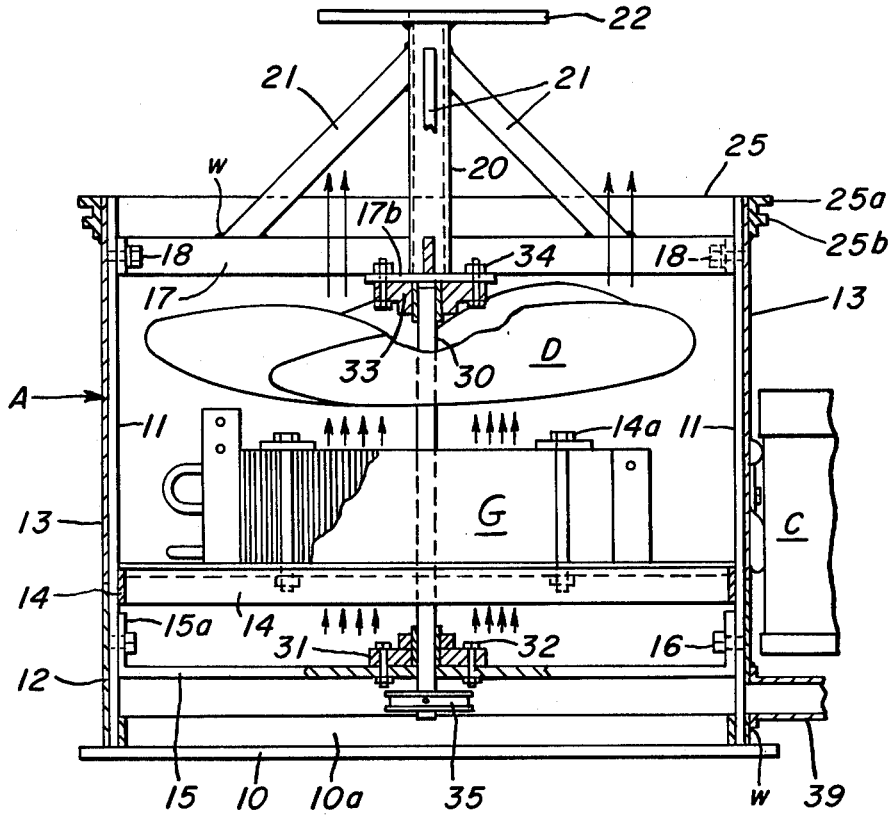
FIG. 2 is a fragmental section in elevation of a base part of the apparatus of FIG. 1, particularly illustrating means for heating and supplying hot air into an open bottom end portion of the permeable bag of FIG. 1.

Referring particularly to FIGS. 1 and 2, I have shown a lower, hot air-supplying base part or casing unit A, and an upper, garment-carrying, finishing or conditioning permeable bag part F that defines an inner, garment-conditioning chamber B. A suitable motor, such as an electric motor C is carried or mounted on the unit A and is adapted to actuate a vertical drive shaft 30 that extends through an open central portion of a heat exchanger G. A fan blade assembly D is secured on the shaft 30 above the heat exchanger G for the purpose of drawing-in ambient air through interstices or openings in a circular, screen or grate-like, louvered, lower shell wall 12, and through air flow passageways or interstices of a typical heat exchanger unit G, upwardly into conditioning chamber B. High pressure steam is supplied from a suitable pipe line source a to a centrally positioned, upwardly positioned, tubular steamer assembly E that extends along the conditioning chamber B defined by the bag F.

The base unit or part A is illustrated as a circular, upwardly extending part that is carried on a base plate member 10. The member 10 has a flange 10*a* that is secured, as by weld metal, between lower end portions of a group of quadrant-positioned, upwardly extending, rib-like support or leg members 11. A bottom-positioned, cruciform-shaped, support frame or bracket 15 (see also FIG. 4), a quadrant-shaped, spoke-like upper frame or bracket 17 (see also FIG. 3), a banding ring 14, and a top, bag-mounting top ring or rim flange 25 may be secured, as by weld metal w, to the upright legs 11. The screen-like, lower shell wall 12 is secured about a lower portion of the part A and has an edge-to-edge aligned relation with a cylindrical, upper, plate-like, enclosing, shell wall 13. The cylindrical, plate-like, main shell wall 13 extends from the ring 14 upwardly along the leg members 11, and is secured (see FIG. 2) along the legs 11 and within the bag-mounting, top ring or rim flange 25.

Figure 4:
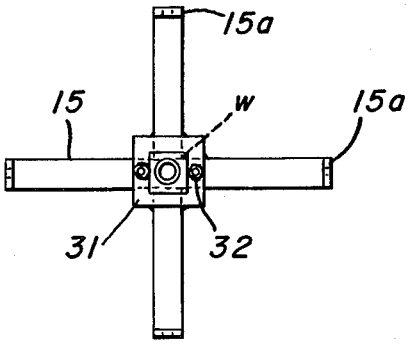
FIG. 4 is a top plan view on the same reduced scale as FIG. 3, particularly illustrating a bottom-positioned, cruciform or quadrant-shaped support frame or bracket that is shown in its mounted position in FIG. 2.

The bottom bracket member 15, see particularly FIGS. 2 and 4, has upwardly extending mounting ears 15*a* that enable it to be secured in position between the upright legs 11 by threaded bolts 16. As shown in FIG. 2, the bracket 15, in addition to spacing and supporting the lower end portions of the four leg members 11, provides a central mounting for the lower end of the fan drive shaft 30 through the agency of a lower bearing assembly 31. As shown in FIG. 2, the bearing assembly 31 is removably secured centrally of the bracket 15 by bolt and nut assemblies 32.

It wil be noted, as shown particularly in FIG. 2, that heat exchanger G is secured by clamping bolt assemblies 14*a* in a transverse positioning to an upper flange of the ring member 14.

Figure 3:
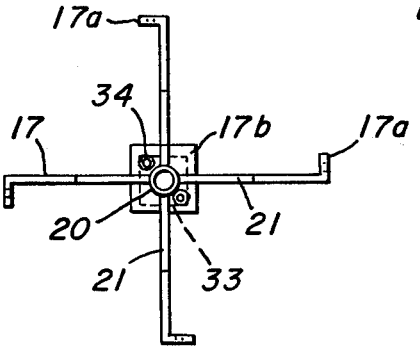
FIG. 3 is a reduced top plan view of a quadrant-shaped or spoke-like, upper frame or bracket that is shown in its mounted position in FIG. 2.

As shown particularly in FIGS. 2 and 3, the quadrant-shaped, spoke-like, upper frame or bracket 17 has bent-over, side-extending, foot or tab portions 17*a* that are secured by threaded bolts 18 to the four, upwardly extending, leg members 11. The bracket 17, at its central axis, carries a mounting plate 17*b* on which an upper bearing assembly 33 is secured by bolt and nut assemblies 34. As shown, the bearing assembly 33 journals the upper end portion of the fan drive shaft 30.

Figure 5:
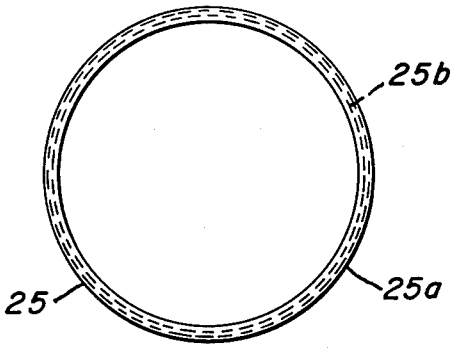
FIG. 5 is a reduced plan view on the scale of FIGS. 3 and 4 of a top ring or rim piece that is employed, as shown in FIGS. 1 and 2, to provide a mounting fit for a selvedge edge that defines the bottom open mouth portion of a permeable bag.
Figure 6:
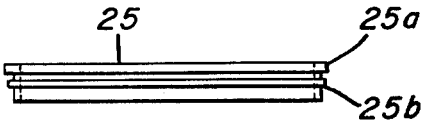
FIG. 6 is a fragmental elevation on the scale of FIG. 5 further illustrating the ring or rim of such figure.

With particular reference to FIGS. 1A, 5 and 6, it will be noted that a centrally positioned, upwardly extending, support post 20 is also carried in a secured relation on the bracket 17. The support post 20, at its lower end, is integrally secured on the mounting plate 17*b*. Four diagonal brace or arm members 21, at their upper ends, are secured as by weld metal w, within side-slotted portions of the post 20. The brace members 21, at their lower ends, are secured, as by weld metal w, on an associated spoke or arm of the bracket 17, see also FIG. 3.

A support table 22 for tube assembly E is carried and secured centrally, as by weld metal, on the upper end of the post 20. To complete the construction of the base part A and to enable internally connecting its hot air supply chamber with garment-finishing or conditioning chamber B that is defined by the permeable bag F of the upper part, the top ring or rim flange 25 is secured along the outer side of the shell wall 13. The ring 25 has an uppermost, annulus-like, rim edge portion 25*a* and a lower rim edge portion 25*b* of slightly smaller diameter which, as shown in FIG. 1, serve to provide a secure, sealed-off mounting for a lower selvage edge of the bag F that defines its open bottom portion. A tight, elastic-like fit of the selvage edge over the edge 25*a* is provided to prevent loss of conditioning fluid (heated air) being supplied from the chamber of the base part A.

The heat exchanger G is supplied with residual steam from return pipe line c, as shown in the schematic of FIG. 7, and ambient air entering through the lower shell wall 12 moves upwardly through passageways of the exchanger G with rotation of the fan blade assembly D. Actuation of the assembly D (see FIG. 1) is effected by upright driven shaft 30, a driven pulley 35 keyed on the lower end of the shaft, a drive belt 36, and a drive pulley 37 on a drive shaft 38 of side-mounted, electric motor unit C. The motor unit C, as particularly shown in FIGS. 1 and 2, is secured to extend from a side of the base part A. A dust cover 39 may be secured by weld metal w on the screen shell wall 12 to enclose the pulley 37 and the portion of the belt 36 that extends from base part A to the drive motor unit C.

An important phase of the invention is represented by the tubular assembly E which is particularly illustrated in FIGS. 7, 8 and 9. This assembly comprises four, equally spaced-apart, upwardly to vertically extending, tube element pairs 41, 42, etc. Each pair is shown as of the same construction, and as distinguished from each other, for reference purposes by prime affixes. Thus, description of elements 40, 41, 42 and 43 will also provide a description of corresponding prime elements. Each pair of elements of the upright tubular assembly E involves an inner, longitudinally upwardly extending, closed-wall tube or pipe element 41 through which entering steam is adapted to circulate in a continuous manner therethrough, and in series into and through similar inner tube elements 41', 41'' and 41''' of the other three pairs. In addition, each pair has an outer perforated tube or pipe element 42 that is in a transversely, outwardly spaced relation with respect to and along the associated inner tube element 41 to define an outer flow chamber to which periodic bursts of steam may be applied, as will be hereinafter more fully explained.

Holes or orifices 43 in a spirally staggered or spaced relation along the outer tube element 42 provide for directly, transversely supplying the hot steam under high pressure within the bag F, substantially along the full vertical extent of its chamber B. The associated inner tube element 41 is, in accordance with contemplated operation, continuously supplied with hot steam for applying heat through its walls indirectly (by conduction) to and along the passageway of the outer tube 42, and to the fluid or air within the chamber B of the bag F.

With reference particularly to the circulating system illustrated in FIGS. 7 and 9, high pressure steam entering from a suitable source, such as a boiler (not shown), flows along input or source pipe line a into a separator H. Less dry or wet steam from the lower condensate collecting portion of the separator H is then flowed in a continuous manner during the conditioning of a garment, through a check valve assembly 55, along a preheating line b into the lower end of a first inner tube element 41 of the first pair. The steam which has completed its upward movement from the line b along the inside of the first pipe or tube element 41 is then introduced along cross connector 44 into the upper end of an adjacent inner tube element 41' to flow downwardly therealong and out from its lower end, through a bottom-positioned, cross-connector 45 into the lower end of a third inner tube 41'' to flow upwardly therealong. The flow from the upper end of the inner element 41'' is then out through a cross-connector 46, and down through the inner tubular element 41''' of the fourth pair of tube elements.

Steam exhausting from the series-connected group of inner pipe elements 41, 41', 41'' and 41''', leaves the assembly through pipe line c to move through heat exchanger G, and thus heat air being supplied upwardly from the chamber of the base part A into the chamber B of the upper part F. Substantially fully heat-spent steam leaves the heat exchanger G piping and flows along condensate pipe line c' into and through steam trap I and check valve 58 to return along to the boiler for reheating and resupply to source pipe line a of the system.

As previously indicated, although it is desirable to supply a constant heat by a closed-off flow of steam through the assembly E, it is also desirable to provide a quick, momentary burst of steam directly to the garment through the agency of the permeable bag of the upper part F. This is accomplished by flowing high pressure, dry steam from the upper portion of the separator H, as controlled automatically by a timer or foot pedal through the agency of an electric solenoid valve 56, to give one or two bursts to the garment in accomplishing the finishing operation. The flow is along steam burst pipe line d, through a manual valve 57 which may be employed to throttle the flow or alternately to manually control the bursts independently of the solenoid-operated valve 56. Steam from the burst piping d simultaneously enters the bottom ends of the outer tube elements 42, 42', 42'' and 42''' through a common manifold pipe connector assembly 50, 51 and 52. See particularly FIG. 9. Thus, steam is introduced from the line d simultaneously upwardly along each of the four, outer, tube elements and through their vertically spaced-apart jet openings 43, 43', 43'' and 43''', directly into the inside of the chamber B.

As particularly illustrated in FIG. 1A, the inner and outer element pairs of the tube assembly E are secured in an upright, substantially equally spaced-apart, square defining arrangement on the table 22 through the agency of coupling mounts 40, 40', 40'' and 40''' that extend from lower ends of the element pairs and are secured to the table.

The bag F may be of a conventional permeable construction, such as of nylon, and is of a type such as mentioned in patents previously listed herein. As will appear from the description of the system shown in FIG. 7, it will be apparent that a maximized use of the heat of steam being supplied along the source line a is accomplished, with remaining residual heat of steam exhausting from the inner elements of the tubular assembly E being applied to the heat exchanger G and thus, to the air that is supplied from ambient air entering through the screen-like side shell wall 12, upwardly from the chamber of the lower part A, through the open bottom end of the bag F into the conditioning chamber B.

The tube elements employed in the assembly, may from the standpoint of heat efficiency, be of copper material, and the holes or feed orifices 43, 43', 43'' and 43''' may be provided by drilling the perforations or holes around the outer or steam burst tubes 42, etc., in an upwardly advancing spiral relationship. In a typical operating cycle employing the apparatus disclosed, steam may be constantly supplied to the pipe line b while a garment is positioned on the bag F. This supply will be continued to avoid cooling the tube assembly E and particularly the outer elements 42, etc., where in a typical operation, a series of garments are to be conditioned or treated. Cooling of the tubes forms condensate which, as previously intimated, is undesirable from the standpoint of a garment being processed. Initially, when the apparatus is heated-up any condensate will be drained-off from the bottom of the unit A.

The inner tubes 41, etc. maintain enough heat to avoid the formation of moisture on the outer or burst tube elements 42, etc., and serve to further the heating of the air which is being introduced from the base part A. The holes or orifices 43, etc. will have a size such, for example, as No. 55, to further insure against moisture burst and thus, spotting the garment. About 80 pounds of steam pressure at a temperature of about 300° F. may be introduced from the source line a. On entering the separator H, the steam strikes a centrally positioned condensing plate, with the hot condensate then dropping to the bottom which is slanted to keep a constant pressure on the line b which may be termed a preheat line. Dry steam then issues from the top opening in the separator H into the burst line d with the desired setting of flow adjusted by the manual valve 57.

The steam solenoid valve 56 may be operated by a foot switch or by a clock type of timer, if desired. The trap I, in what may be termed condensate line c', slows down the return flow and removes excess moisture from the steam to further the maintenance of about 80 pounds of steam pressure as applied to the assembly E. In the drawings, the solid arrows show the flow of so-called burst steam and the dotted arrows show the flow of so-called heating steam.

Primarily, the inner tubular elements 41, etc. which define a closed, series-flow system may be employed to maintain a substantially constant heat within the chamber B and prevent the forming of condensate. On the other hand, the steam burst elements 42, etc. of the tubular assembly E may be employed to provide conditioning steam directly to the bag F and thus, to the inside of a garment. A preliminary heating-up of the assembly E may be accomplished by passing steam through the line b for a minute or two, then a typical garment finishing operation may be effected by applying dry steam through line d, initially for about 3 to 5 seconds; next, the fan D may be actuated to inflate it, and steam bursts may be applied from line d to the bag F for 2 to 3 seconds. Finally, the steam burst supply from the line d may be turned-off, with the flow through heating line b continued, while the fan blade assembly D is rotated to continue the supply of hot air for about 3 to 8 seconds after which the garment may be removed. As will be appreciated, the full cycle of operation (after heat-up) may involve a period of approximately 8 to 12 seconds to enable a production-line type of garment finishing. Throughout the operations, heating steam will be supplied to the inner elements 41, etc. of each of the tube pairs 41, 42, etc.

I claim:

1. In a high speed improved garment processing apparatus for upright finishing a shirt or blouse-like garment, having a base part and an aligned upper part, wherein the base part has an upwardly extending hollow casing defining an ambient air heating chamber therein, wherein the casing has a lower open wall portion through which ambient air is introduced into the heating chamber, and wherein the upper part has an upwardly extending permeable garment-receiving bag that defines a garment finishing chamber; a heat exchanger mounted in the casing above said open wall portion to extend substantially centrally across the air heating chamber, said heat exchanger defining flow passages for upward movement of and heating of air within the heating chamber, the permeable bag having a lower open end portion and the casing having an upper open end portion adapted to receive and mount the lower open end portion of the bag thereon, a rotating blade assembly operatively positioned within the heating chamber of the casing for drawing-in ambient air through said open wall portion and moving it upwardly through interstices of said heat exchanger into the lower open end portion of the permeable bag, a steam supplying tubular upright assembly securely positioned on and above the casing to extend centrally upwardly along and within the permeable bag, said tubular assembly having a group of transversely spaced-apart longitudinally extending dual-wall tubular element pairs, each said pair having a solid wall inner tube defining a heat transfer passageway therealong, each said pair having a perforated wall outer tube in an outwardly spaced relation about and along said inner tube, a manifold connected to said outer tubes for simultaneously supplying steam thereto, said inner tubes being series-connected for continuously supplying heat therefrom along the spacing between said inner and outer tubes and along the garment processing chamber during the finishing of a garment, a steam separator, means supplying hot pressurized steam from a source to said separator, means connecting an upper portion of said separator to said manifold for introducing dry steam bursts directly into the garment finishing chamber through the perforated walls of said outer tubes, and means for continuously supplying steam from a lower condensate receiving portion of said separator to and along said series connected inner tubes and from said inner tubes to said heat exchanger for supplying heat within the spacing between said inner and outer tubes to the garment finishing chamber, and to the heat exchanger for continuously heating air moving upwardly therethrough into the garment finishing chamber.

2. In an improved apparatus as defined in claim 1, said lower open wall portion of the casing being a screen-like shell wall about the casing.

3. In an improved apparatus as defined in claim 1, a motor-driven shaft operatively mounted within the casing to extend upwardly through said heat exchanger, and said rotating blade assembly being secured on an upper end of said shaft within an upper portion of the chamber of the casing.

4. In an improved apparatus as defined in claim 3, a motor mounted in position outwardly from one side of the casing, and drive means extending from said motor into the casing and operatively connected to a lower end portion of said shaft for actuating it.

5. In a high speed improved garment processing apparatus for upright finishing a shirt or blouse-like garment, having a base part and an aligned upper part, wherein the base part has an upwardly extending hollow casing defining an ambient air heating chamber therein, wherein the casing has a lowermost open wall portion through which ambient air is introduced into the heating chamber, and wherein the upper part has an upwardly extending permeable garment-receiving bag that defines a garment finishing chamber; the permeable bag having a lower open end portion and the casing having an upper open end portion adapted to receive and mount the lower open end portion of the bag thereon, a lower spider frame securely mounted within the casing above the screen-like wall portion, an upper spider frame securely mounted within and extending across the upper open end portion of the casing, a heat exchanger horizontally mounted in the casing above said lower spider frame and between it and said upper spider frame to extend substantially centrally across said air heating chamber, said heat exchanger defining through flow passages for upward movement and heating of air within the heating chamber, a motor-driven shaft extending substantially centrally upwardly from a lower portion of the air heating chamber through said heat exchanger and along the casing, said upper and lower spider frames having bearings carried substantially centrally thereby and journaling upper and lower end portions of said motor-driven shaft, a blade assembly secured on the upper end portion of said shaft above said heat exchanger within the air heating chamber of the casing for moving air upwardly from the lower portion of the heating chamber through said heat exchanger and through said upper and lower spider frames into said lower open end portion of the permeable bag, a centrally positioned upwardly extending fixed mounting post carried by said upper spider frame, a support table mounted on an upper end of said mounting post, a steam supplying upright tubular assembly securely positioned on said support table to extend centrally upwardly along and within the permeable bag, said tubular assembly having a group of transversely spaced-apart longitudinally extending dual-wall tubular element pairs, each said pair having a solid wall inner tube defining a heat transfer passageway therealong, each said pair having a perforated wall outer tube in an outwardly spaced relation about and along said inner tube, said inner tubes being series-connected for continuously supplying heat from their walls along the spacing between said inner and outer tubes and along the garment processing chamber during the finishing of a garment, means for supplying high pressure dry steam in the form of bursts along the spacing between said inner and outer tubes and through the perforated walls of said outer tubes directly into the permeable bag, means for initially separating out less dry steam, means for supplying the less dry steam continuously in series through said inner tubes to maintain the spacing between said inner and outer tubes and the garment finishing chamber in a heated condition, and means for moving steam from said inner tubes through the heat exchanger for continuously heating the air being moved upwardly therethrough into the said garment finishing chamber.

6. In an improved apparatus as defined in claim 5, said means for initially separating out less dry steam being a condensate separator, said means for supplying high pressure dry steam being connected to an upper portion of said separator, and said means for supplying the less dry steam being connected to a lower condensate-receiving portion of said separator.

* * * * *